US005370816A

United States Patent [19]

Balzer et al.

[11] Patent Number: 5,370,816

[45] Date of Patent: Dec. 6, 1994

[54] DETERGENT COMPOSITION CONTAINING A MIXTURE OF ALKYL POLYGLYCOSIDES

[75] Inventors: Dieter Balzer, Haltern; Rudolf Beck; Willi Gasber, both of Marl, all of Germany

[73] Assignee: Huels Aktiengesellschaft, Marl, Germany

[21] Appl. No.: 54,829

[22] Filed: Apr. 30, 1993

Related U.S. Application Data

[63] Continuation of Ser. No. 733,845, Jul. 22, 1991, abandoned.

[30] Foreign Application Priority Data

Sep. 13, 1990 [DE] Germany ..... 4029035

[51] Int. Cl.[5] ..... C11D 90/00; C11D 9/26

[52] U.S. Cl. ..... 252/132; 252/174.17; 252/174.21; 252/DIG. 1; 252/DIG. 14

[58] Field of Search ..... 252/174.17, 174.21, 252/DIG. 1, DIG. 14, 132

[56] References Cited

U.S. PATENT DOCUMENTS

| | | | |
|---|---|---|---|
| H171 | 12/1986 | McDaniel | 252/174.17 |
| 3,547,828 | 12/1970 | Mansfield et al. | 252/351 |
| 4,483,780 | 6/1983 | Llenado | 252/174.17 |
| 4,780,234 | 10/1987 | Malik | 252/174.17 |
| 5,025,069 | 6/1991 | Deguchi et al. | 252/174.17 |
| 5,043,091 | 6/1989 | Toshi et al. | 252/174.17 |
| 5,073,293 | 12/1991 | Deguchi | 252/174.17 |
| 5,104,585 | 4/1992 | Fabry | 252/555 |
| 5,118,440 | 6/1992 | Cutler et al. | 252/174.17 |

FOREIGN PATENT DOCUMENTS

| | | | |
|---|---|---|---|
| 0075994 | 4/1983 | European Pat. Off. . | |
| 0075995 | 4/1983 | European Pat. Off. | 252/174.17 |
| 0364744 | 9/1989 | European Pat. Off. | 252/174.17 |
| 0474915A1 | 3/1992 | European Pat. Off. . | |
| 0474915 | 3/1992 | Germany | 252/174.17 |
| 2145696 | 5/1990 | Japan . | |
| 8605187 | 7/1985 | WIPO | 252/174.17 |

*Primary Examiner*—Paul Lieberman
*Assistant Examiner*—Kery A. Fries
*Attorney, Agent, or Firm*—Oblon, Spivak, McClelland, Maier & Neustadt

[57] ABSTRACT

Low-foaming, liquid or pulverulent machine detergents today consist, in the surfactant portion, mainly of surfactants based on petrochemicals; the biodegradability and ecotoxicity frequently does not reach the level of surfactants based on natural materials. Accordingly, a surfactant combination for low-foaming machine detergents is proposed, which is predominantly prepared from renewable raw materials; washing results and biodegradability are excellent. The surfactant portion of these machine detergents consists of fatty alcohol ethoxylates, soaps and alkyl polyglycosides which consist at least of a mixture of alkylglycosides of varying chain length and varying degrees of glycosylation.

17 Claims, No Drawings

DETERGENT COMPOSITION CONTAINING A MIXTURE OF ALKYL POLYGLYCOSIDES

The present application is a continuation of application Ser. No. 07/733,845, filed Jul. 22, 1991, now abandoned.

BACKGROUND OF THE INVENTION

1. Field of the Invention

The present invention relates to liquid or pulverulent preparations for the washing of textiles, the surfactants of which are prepared predominantly from renewable raw materials.

2. Discussion of the Background

Today, liquid detergents consist especially of anionic surfactants, in particular alkylbenzenesulphonates, fatty alcohol ethoxylates and soap, whereas washing powders contain builders, bleaching agents and other electrolytes in addition to surfactants (alkylbenzenesulphonates and fatty alcohol ethoxylates) as essential active compounds. The common feature of both liquid and pulverulent detergent formulations is that the surfactants used are based on petrochemicals.

In view of the future raw material situation (petroleum shortage), this petrochemical base is a significant disadvantage. A further disadvantage is that the levels of biodegradability and ecotoxicity of petroleum-based surfactants frequently are far less acceptable than the corresponding levels shown by surfactants based on natural materials.

SUMMARY OF THE INVENTION

Accordingly, one object of the present invention is to provide a surfactant combination for low-foaming detergents which is predominantly prepared from renewable raw materials.

A further object of the present invention is to provide a detergent composition giving improved washing results.

A further object of the present invention is to provide a detergent composition which is highly biodegradable.

A further object of the present invention is to provide a detergent composition which can be prepared in either liquid or pulverulent form.

These and other objects, which will become apparent during the following detailed description of the present invention, is achieved by a surfactant combination which predominantly contains alkyl polyglycosides, one or more fatty alcohol ethoxylates and soap.

DETAILED DESCRIPTION OF THE PREFERRED EMBODIMENTS

In accord with the above-described objects, the present invention relates to a low-foaming, liquid or pulverulent machine detergent containing:

(A) 3 to 30% of a mixture of at least one alkyl polyglycoside of the formula (I)

$$R—O—Z_n \quad (I)$$

in which R represents a linear or branched, saturated or unsaturated alkyl radical having 7 to 11 carbon atoms or mixtures thereof and $Z_n$ represents a glycosyl or polyglycosyl radical having an average value of from 1 to 3 hexose or pentose units, and at least one alkyl polyglycoside of the formula (II)

$$R'—O—Z'_m \quad (II),$$

in which R' is a linear or branched, saturated or unsaturated alkyl radical having 12 to 18 carbon atoms or mixtures thereof and $Z'_m$ represents a glycosyl or polyglycosyl radical having an average value of from 1 to 3 hexose or pentose units;

(B) 3 to 30% of one or more fatty alcohol ethoxylates;

(C) 5 to 30% of one or more soaps; and (D) 0 to 5% of other surfactants.

In a further embodiment, the present composition contains at least 5% of one or more non-surfactant components.

The use of an alkyl polyglycoside in combination with either fatty alcohol ethoxylates or with anionic surfactants is known per se. Thus German Offenlegungsschrift 593,422 has already mentioned the detergency-boosting effect of an alkyl glycoside in soaps. Later publications, such as EP-A 0,075,994, 075,995, 075,996, 094,118 and 317,614 have described the use of alkyl polyglycosides in combination with anionic and/or nonionic surfactants in detergents.

However, surprisingly, it has now been found that the formulation according to the present invention having two different alkyl polyglycosides gives excellent washing results.

The alkyl polyglycoside used is a mixture of at least 2 components which, on the one hand, differ considerably with respect to the chain length of their alkyl groups and, on the other hand, are used in different concentrations. The main components of these are alkyl polyglycosides whose alkyl groups contain 12 to 18 carbon atoms; secondary components are those whose alkyl group contains 7 to 11 carbon atoms. According to the present invention, the content of the short-chain alkyl polyglycoside(s) in the above-mentioned surfactant portion is 1 to 10%, and that of the long-chain alkyl polyglycoside(s) is 2 to 20%.

The balance of the present detergent composition contains fatty alcohol ethoxylates and, depending on its physical state, other components selected from further surfactants in small amounts, sequestering agents, bleaching agents, optical brighteners, antiredeposition agents, corrosion inhibitors, foam regulators, stabilizers, enzymes, enzyme stabilizers, electrolytes, hydrotropic substances, solubilizers, and the like.

Alkyl Polyglycosides

Shorter-chain alkyl polyglycosides used according to the present invention satisfy the formula (I)

$$R—O—Z_n \quad (I),$$

in which R represents a linear or branched, saturated or unsaturated aliphatic alkyl radical having 7 to 11 carbon atoms or mixtures thereof, $Z_n$ represents a polyglycosyl radical or a mixture of polyglycosyl radicals, wherein $Z_n$ has an average value of from 1.0 to 3.0 hexose or pentose units for the total shorter-chain alkyl polyglycosides of formula (I) in the composition.

Preference is given to alkyl polyglycosides having alkyl radicals of 8 to 11 carbon atoms and a polyglycosyl radical where n is an average value of from 1.1 to 2. Polyglucosides derived from one or more glucose units are particularly preferred.

Longer-chain alkyl polyglycosides used according to the present invention satisfy the formula (II)

$$R'—O—Z'_m \quad (II),$$

in which R' represents a linear or branched, saturated or unsaturated aliphatic radical having 12 to 18 carbon atoms or mixtures thereof and $Z_m$ represents a polyglycosyl radical or a mixture of polyglycosyl radicals, wherein $Z'_m$ has an average value of from 1.0 to 3 hexose or pentose units for the total longer-chain alkyl polyglycosides of the formula (II) in the composition.

Alkyl polyglycosides having fatty alkyl radicals of 12 to 16 carbon atoms and a polyglycosyl radical where n is an average value of from 1.1 to 2 are preferred. Polyglycosides derived from one or more glucose units are particularly preferred.

The alkyl polyglycosides used according to the present invention can be prepared by known processes based on renewable raw materials.

For example, dextrose is reacted in the presence of an acid catalyst with n-butanol to give butyl polyglycoside mixtures, which are transglycosylated with long-chain alcohols also in the presence of an acid catalyst to give the desired alkyl polyglycoside mixtures. Alternatively, dextrose is reacted directly with the desired long-chain alcohol.

The structure of the products is variable within certain limits. The alkyl radical R or R' is determined by the selection of the long-chain alcohol. For economic reasons, alcohols which are accessible on a large scale and have 7 to 18 carbon atoms are preferred, particularly natural alcohols from the hydrogenation of one or more carboxylic acids having from 7 to 18 carbon atoms, or derivatives thereof. Ziegler alcohols or oxo alcohols of 7 to 18 carbon atoms can also be used.

The polyglycosyl radicals $Z_n$ and $Z_m$ are determined, on the one hand, by the selection of the carbohydrate and, on the other hand, by the desired average degree of polymerization n and m, for example according to German Offenlegungsschrift 1,943,689. In principle, carbohydrates such as starch, maltodextrins, dextrose, galactose, mannose, xylose and the like, can be used. Carbohydrates which are available on a large scale are preferred; for example, starch, maltodextrins, and, in particular, dextrose. Since the alkyl polyglycoside syntheses of economic interest do not proceed with regio- and stereoselectivity, the alkyl polyglycosides are always a mixture of oligomers, which in turn are mixtures of various isomeric forms. They are present side by side in pyranose and furanose forms which have $\alpha$- and $\beta$-glycosidic bonds. The linking sites between two saccharide radicals also differ.

Alkyl polyglycosides used according to the present invention can also be prepared by mixing alkyl polyglycosides with alkyl monoglycosides. The latter can be obtained from or enriched with alkyl polyglycosides, for example, according to EP-A 0,092,355, by means of polar solvents, such as acetone.

The degree of glycosylation is advantageously determined by means of $^1$HNMR (proton nuclear magnetic resonance spectroscopy).

The detergents according to the present invention contain 1 to 10% of short-chain alkyl polyglycoside, preferably 2–8%, and 2–20% of long-chain alkyl polyglycoside, preferably 3–15%, the ratio of short-chain to long-chain content being 1:10 to 2:1, preferably 2:10 to 1:1.

Compared with almost all other surfactants used in detergents, the alkyl polyglycosides are considered extremely compatible with the environment. Thus, the degree of biodegradation for the alkyl polyglycosides according to the present invention is 96±3% determined by means of a DOC analysis simulation model for water treatment plants. In this testing procedure (total degradation), a degree of degradation of ≧70% indicates that the substance is highly degradable.

Likewise, the acute oral toxicity LD 50 (rat) at >10,000 mg/kg and the aquatic toxicity LC 50 (orfe) at about 12 mg/l and EC 50 (daphnia) at 30 mg/l are more favorable by a factor of 3 to 5 than the corresponding values of today's most important surfactants. The same is true of the skin and mucous membrane compatibility.

Fatty alcohol ethoxylates

Fatty alcohol ethoxylates are compounds of the formula (III)

$$R''—O—(CH_2—CH_2—O)_xH, \quad (III)$$

in which R'' is a linear or branched, saturated or unsaturated alkyl radical having 8 to 22, preferably 10 to 20, carbon atoms and x is 2 to 20, preferably 3 to 15.

The compounds are in general prepared by an addition reaction of ethylene oxide with longer-chain alcohols in the presence of basic or acid catalysts. For economic reasons, alcohols which are available on a large scale from the hydrogenation of carboxylic acids or carboxylic acid derivatives and have 8 to 22 carbon atoms are favorable. However, Ziegler alcohols or oxo alcohols can also be used.

As is known, the alcohol ethoxylates are extremely biodegradable; their data with respect to aquatic toxicity, skin and mucous membrane compatibility are also favorable. The detergents according to the invention contain 3 to 30% of fatty alcohol ethoxylates, which can also be mixtures. A content of 5 to 20% is preferred.

Soap

Fatty acids or salts thereof according to the invention have the formula (IV)

$$R'''COOP \quad (IV),$$

in which R''' is a saturated or unsaturated alkyl radical having 8 to 22 carbon atoms and P is hydrogen, alkali metal, ammonium or mono-, bis- or trialkanolammonium.

The detergents according to the invention contain 5 to 30%, preferably 7 to 20%, of soap, which in most cases is a mixture of various soaps.

Further surfactant components

According to the invention, up to 5% of further anionic, nonionic, zwitterionic and ampholytic surfactants can be used. They are in particular alkanesulphonates, olefin sulphonates, alkylbenzenesulphonates, $\alpha$-sulpho fatty acid esters, fatty alcohol sulphates, fatty alcohol ether sulphates, sulphosuccinate esters, alkanol ethoxylates, fatty alkanolamides, amine oxides, betaines, sulphobetaines, and the like.

Further non-surfactant components

In a preferred embodiment, further non-surfactant components comprise at least 5% of the present composition, preferably at least 10%, and particularly preferably at least 20%.

Suitable non-surfactant components are predominantly builders. According to the present invention, water-soluble builders, such as various polyphosphates, phosphonates, carbonates, polycarboxylates, citrates, polyacetates, such as nitrilotriacetic acid (NTA) and/or ethylenediaminetetraacetic acid (EDTA), and the like, or mixtures thereof, are used. These compounds are preferably used in the form of their alkali metal salts, preferably sodium salts. Sodium sulphate, although it is not a sequestering agent, also is a suitable non-surfactant component. The use of water-insoluble builders, such as aluminosilicates of suitable particle size (cf. EP-A 0,075,994) is also suitable, according to the present invention. The concentration of the builders in the detergent is 0 to 70%, preferably 0 to 50%.

Furthermore, bleaching agents, such as sodium perborate or percarbonate, and if desired, in combination with bleaching activators, such as tetraacetylethylenediamine (TAED), and the like, are used according to the present invention; other bleaching agents (cf. K. Engel, Tenside Surfactants 25, p. 21 (1988)) are of course also suitable. The concentration of the bleaching agents is 0 to 40%, preferably 0–30%.

If desired, standardizing agents, such as low-molecular weight mono- or dihydric alcohols, alkyl ethers of polyhydric alcohols, hydrotropic agents, such as alkylbenzenesulphonates having 1 to 3 carbon atoms in the alkyl radical, mono-, di-, and/or trialkanolamines or urea, enzymes, such as, in particular, proteases and enzyme stabilizers, corrosion inhibitors, such as alkali metal silicates, optical brighteners, in particular those based on stilbene and pyrazoline, form regulators, antiredeposition agents such as carboxymethyl-cellulose, perfume oils, dyes and further ingredients customary for liquid or pulverulent detergents, such as water, may be used according to the present invention, in an amount sufficient bring the total of the composition to 100%.

The total concentration used in the machine detergents according to the present invention is preferably 0.3–20 g/l for the surfactant portion. A total concentration of 0.5–10 g/l is particularly preferred.

Other features of the invention will become apparent in the course of the following descriptions of exemplary embodiments which are given for illustration of the invention are not intended to be limiting thereof.

EXAMPLES

The examples which follow illustrate the invention. Apart from the surfactant components mentioned and used according to the invention, the liquid detergent formulations listed in Table 1 each contain 6% of triethanolamine, 12% of ethanol, 6% of 1,2-propylene glycol and the balance of water, to add up to a total of 100%.

Apart from the surfactant components mentioned and used according to the invention, the powders listed in Table 2 each contain 10% of sodium perborate, 4.5% of Na,Mg silicate, 14% of $Na_2SO_4$, 24% of Versalite P, 3% of Sokalan CP 5, 8% of $Na_2CO_3$, 3.5% of TAED and 0.4% of an organophosphonate.

The foaming power was determined according to DIN 53,902, part 1. The concentration of wash-active substance was in each case 1 g/l, and the foam volume was determined after 5 minutes. The washing power was determined both in a Linitest laboratory washing machine (i.e. at moderate mechanical stress) and in a standard household machine, in which also the foaming was tested, which corresponded approximately to the DIN values.

The model fabrics were WFK (Wäschereiforschung Krefeld) test swatches of 11×18 cm in size soiled with human sebum pigment: polyester (PE), blended fabric (BF) and cotton (CT), and drinking water (13° of German hardness) as water. The polyester fabric was washed at 30° C., and the blended fabric and cotton were washed at 60° C. In the case of the Linitest laboratory washing machine, the concentration of active compound was 1 g/l, in the case of the household washing machine, it was 5 g/l, the pH was in each case about 7, the liquor ratio about 60:1 or 4:1, and the washing times in both cases were about 30 minutes.

With the Linitest washing machine, the washing operation was repeated twice after rinsing the fabric each time. The washing values, after drying of the fabrics, was, as is usual, measured by spectrophotometry, relative to a white standard (Datacolor, 560 nm).

Liquid formulations

Table 1 shows a comparison of the properties of the detergents according to the present invention as liquid formulation with those of other known combinations and with a liquid commercial brand detergent, for which an optimized recipe can be assumed. Clearing point and viscosity are approximately those of the standard customary in the market for liquid detergent. The foaming power of the formulations according to the invention, without any further regulating additives, has variable values. This is in particular true of the washing power.

Compared with a commercial brand detergent (Example 13 (C)) and even with the formulations containing alkyl polyglycosides (Example 1(C) to 5(C)), the detergents according to the present invention are far superior in their washing activity.

Powder formulations:

Table 2 shows a comparison of the properties of pulverulent detergent formulations according to the present invention with those of a known combination and with a commercial brand detergent. Bulk density and foaming power were determined by DIN methods.

The solubility could be evaluated by plotting the electric conductivity as a function of time, in which 80% of the average final conductivity upon dissolution of 3 g of powder in 800 ml of drinking water (13° of German hardness) was taken as the measurement value. The measured values have an error of ±5%.

Apart from a somewhat higher bulk density, which is typical for agglomerated washing powders compared with spray-dried commercial products (Example 23(C)), the powders according to the invention have a very similar behavior and are far better in their washing values.

It is surprising that when alkyl polyglycosides are used, that the significantly improved washing power, in the case of blended fabrics in particular, is improved once again by the formulation according to the present invention.

The following abbreviations were used in the tables:

Triton® BG 10—shorter-chain ($C_7$–$C_{11}$) alkyl polyglycoside from Rohm and Haas Triton® CG 110—shorter-chain ($C_7$–$C_{11}$) alkyl polyglycoside from Rohm and Haas $C_{12}C_{14}G_{1.2}$—$C_{12/14}$-alkyl polyglycoside having a degree of glycosidation of 1.2

$C_{12}C_{13}G_{1.1}$—$C_{12/13}$-alkyl polyglycoside having a degree of glycosidation of 1.1

$C_{12}C_{13}G_{1.7}$—$C_{12/13}$-alkyl polyglycoside having a degree of glycosidation of 1.7

MARLIPAL® 24/60—$C_{12/14}$-alkenol ethoxylate containing 6 mol of ethylene oxide per mol of alkenol MARLIPAL ® 24/80—$C_{12/14}$-alkenol ethoxylate containing 8 mol of ethylene oxide per mol of alkenol Soap 1—coconut fatty acid neutralized with triethanolamine Soap 2—90 parts of beef fat, 10 parts of coconut fatty acid, both saponified with NaOH PE—polyester BF—blended fabric CT—cotton Obviously, numerous modifications and variations of the present invention are possible in light of the above teachings. The present invention may suitably comprise, consist essentially of, or consist of the components (A), (B), (C), (D), and optionally, one or more non-surfactant components, and may be practiced in the absence of any component which is not specifically described herein. It is therefore to be understood that within the scope of the appended claims, the invention may be practiced otherwise than as specifically described herein.

TABLE 1 (a)

Liquid detergents based on an alkyl polyglycoside combination/fatty alcohol ethoylate/soap

| Surfactants | Example No. 1(C) | 2(C) | 3(C) | 4(C) | 5(C) | 6 | 7 | 8 | 9 | 10 | 11 | 12 | 13(C) |
|---|---|---|---|---|---|---|---|---|---|---|---|---|---|
| Triton ® BG 10 | 15 | — | — | — | — | 5 | 3.8 | 5 | — | — | — | — | liquid |
| Triton ® CG 110 | — | 15 | — | — | — | — | — | — | 5 | 3.8 | 3.8 | 5 | brand |
| $C_{12}C_{14}G_{1.2}$ | — | — | 15 | — | — | 10 | 11.2 | 10 | — | 11.2 | — | — | name |
| $C_{12}C_{13}G_{1.1}$ | — | — | — | 15 | — | — | — | — | 10 | — | 11.2 | — | detergent |
| $C_{12}C_{13}G_{1.7}$ | — | — | — | — | 15 | — | — | — | — | — | — | 10 | |
| MARLIPAL ® 24/60 | 15 | — | 15 | 15 | — | 15 | 15 | — | 15 | 15 | 15 | 15 | |
| MARLIPAL ® 24/80 | — | 15 | — | — | 15 | — | — | 15 | — | — | — | — | |
| Soap 1 | 10 | 10 | 10 | 10 | 10 | 10 | 10 | 10 | 10 | 10 | 10 | 10 | |

(C): comparative example

TABLE 1(b)

Properties and results of Examples of Table 1(a)

| Surfactants | Example No. 1(C) | 2(C) | 3(C) | 4(C) | 5(C) | 6 | 7 | 8 | 9 | 10 | 11 | 12 | 13(C) |
|---|---|---|---|---|---|---|---|---|---|---|---|---|---|
| Clearing point (°C.) | −10 | −10 | −5 | −3 | −5 | −3 | −2 | −5 | −5 | −4 | −5 | −2 | — |
| Viscosity 25° C. (mPa) | 50 | 50 | 50 | 50 | 48 | 50 | 48 | 50 | 48 | 46 | 48 | 60 | 90 |
| Foaming power 60° C. DIN after 30 sec | 50 | 50 | 30 | 70 | 40 | 50 | 40 | 50 | 50 | 40 | 40 | 30 | 40 |
| Washing power (diffuse reflection (%)) | | | | | | | | | | | | | |
| Linitest | | | | | | | | | | | | | |
| PE 30° C. | 14 | 11 | 17 | 18 | 17 | 19 | 20 | 19 | 19 | 21 | 23 | 21 | 13 |
| BF 60° C. | 23 | 24 | 27 | 26 | 28 | 29 | 29 | 34 | 30 | 32 | 30 | 29 | 17 |
| CT 60° C. | 33 | 33 | 34 | 34 | 36 | 37 | 39 | 40 | 40 | 39 | 40 | 39 | 37 |
| Washing machine | | | | | | | | | | | | | |
| BP 60° C. | 48 | 53 | 55 | 56 | 56 | 61 | 59 | 62 | 61 | 62 | 59 | 60 | 42 |
| CT 60° C. | 54 | 56 | 59 | 58 | 57 | 64 | 59 | 60 | 65 | 64 | 65 | 63 | 52 |

(C): comparative example

TABLE 2(a)

Pulverulent formulations

| Surfactants | Example No. 14(C) | 15(C) | 16(C) | 17 | 18 | 19 | 20 | 21 | 22 | 23(C) |
|---|---|---|---|---|---|---|---|---|---|---|
| Tritin ® BG 10 | — | — | — | — | — | — | — | 1.7 | 1.7 | pulverulent |
| Tritin ® CG 110 | 5 | — | — | 1.7 | 1.3 | 1.3 | 2.5 | — | — | brand |
| $C_{12}C_{14}G_{1.2}$ | — | 5 | — | 3.3 | 3.7 | — | — | 3.3 | — | name |
| $C_{12}C_{14}G_{1.1}$ | — | — | 5 | — | — | 3.7 | 2.5 | — | 3.3 | detergent |
| MARLIPAL ® 24/60 | 5 | 5 | 5 | 5 | 5 | 5 | 5 | 5 | 5 | |
| Soap 2 | 5 | 5 | 5 | 5 | 5 | 5 | 5 | 5 | 5 | |

(C): comparative examples

TABLE 2(b)

Properties and results of Examples of Table 2(a)

| Surfactants / Results | Example No. 14(C) | 15(C) | 16(C) | 17 | 18 | 19 | 20 | 21 | 22 | 23(C) |
|---|---|---|---|---|---|---|---|---|---|---|
| Bulk density g/l | 570 | 560 | 550 | 560 | 550 | 540 | 550 | 540 | 560 | 460 |
| Solubility (min) | 1.3 | 1.2 | 1.1 | 1.1 | 1.1 | 1.2 | 1.2 | 1.2 | 1.1 | 1.5 |
| Foaming power 60° C. DIN after 30 sec | 220 | 180 | 160 | 190 | 180 | 170 | 180 | 190 | 180 | 150 |
| Washing powder (diffuse reflection (%)) | | | | | | | | | | |
| Washing machine | | | | | | | | | | |
| BF 60° C. | 53 | 54 | 54 | 54 | 58 | 59 | 58 | 60 | 59 | 45 |

TABLE 2(b)-continued

| Surfactants | Properties and results of Examples of Table 2(a) | | | | | | | | | |
|---|---|---|---|---|---|---|---|---|---|---|
| | Example No. | | | | | | | | | |
| Results | 14(C) | 15(C) | 16(C) | 17 | 18 | 19 | 20 | 21 | 22 | 23(C) |
| CT 60° C. | 59 | 59 | 60 | 62 | 63 | 62 | 61 | 61 | 61 | 58 |

(C): comparative examples

What is claimed as new and desired to be secured by Letters Patent of the United States is:

1. A low-foaming detergent composition comprising
(A) a mixture which is a bimodal distribution of
(i) from 2 to 10% by weight of a mixture of shorter-chain alkyl polyglycosides of the formula (I)

$$R—O—Z_n \quad (I)$$

in which R is a technical mixture of linear or branched, saturated or unsaturated alkyl radicals having 7 to 11 carbon atoms and $Z_n$ represents a polyglycosyl radical having an average value of from 1 to 3 hexose or pentose units or mixtures thereof, and
(ii) from 3 to 20% by weight of a mixture of longer-chain alkyl polyglycosides of the formula (II)

$$R'—O—Z'_m \quad (II)$$

in which R' is a mixture of linear or branched, saturated or unsaturated alkyl radical having 12 to 18 carbon atoms and $Z'_m$ represents a polyglycosyl radical having an average value of from 1.1 to 2 hexose or pentose units or mixtures thereof,
(B) 3 to 30% of a fatty alcohol ethoxylate,
(C) 5 to 30% of a soap, and
(D) 0 to 5% of other surfactants.

2. The low-foaming detergent composition according to claim 1, wherein the shorter-chain alkyl polyglycosides of formula (I) and the longer-chain alkyl polyglycosides of formula (II) are present in a ratio of from 1:10 to 2:1, respectively.

3. The low-foaming detergent composition according to claim 1, further comprising at least 5% by weight of the composition of non-surfactant components.

4. The low-foaming detergent composition according to claim 3, further comprising at least 10% by weight of the composition of non-surfactant components.

5. The low-foaming detergent composition according to claim 4, further comprising at least 20% by weight of the composition of non-surfactant components.

6. The low-foaming detergent composition according to claim 1, wherein the alkyl polyglycosides are fatty alcohol glucosides, where n and m are average values of from 1.1 to 2.

7. The low-foaming detergent composition according to claim 1, wherein the fatty alcohol ethoxylate has the formula (III)

$$R''—O—(CH_2—CH_2—O)_xH \quad (III),$$

in which R'' is a linear or branched, saturated or unsaturated alkyl radical having from 8 to 22 carbon atoms and x is from 2 to 20.

8. The low-foaming detergent composition according to claim 7, wherein R'' in formula III represents an alkyl radical of from 10 to 20 carbon atoms and x is from 3 to 15.

9. The low-foaming detergent composition according to claim 1, wherein the soap has the formula (IV)

$$R'''COOP \quad (IV),$$

in which R''' is a saturated and/or unsaturated alkyl radical having from 8 to 22 carbon atoms and P is selected from the group consisting of hydrogen, alkali metals, ammonium, and alkanolammonium.

10. The low-foaming detergent composition according to claim 3, wherein the nonsurfactant components are selected from the group consisting of builders, bleaching agents, bleaching activators, standardizing agents, enzymes, stabilizers, antiredeposition agents, corrosion inhibitors, optical brighteners, dyes and perfume oils.

11. The low-foaming detergent composition according to claim 1, further comprising water, wherein the concentration of components (A), (B), (C) and (D) in said water is 0.3 to 20 g/l.

12. The low-foaming detergent composition of claim 1, wherein said shorter-chain alkyl polyglycosides of the formula (I) is present in an amount from 2 to 8% by weight.

13. The low-foaming detergent composition of claim 1, wherein said longer-chain alkyl polyglycosides of the formula (II) is present in an amount of from 3 to 15% by weight of the composition.

14. The low-foaming detergent composition of claim 12, wherein said longer-chain alkyl polyglycosides of the formula (II) is present in an amount from 3 to 15% by weight of the composition.

15. A low-foaming detergent composition, produced by mixing a bimodal distribution of
(A)(i) from 2 to 10% by weight of a technical mixture of shorter-chain alkyl polyglycosides of the formula (I)

$$R—O—Z_n \quad (I)$$

in which R is a linear or branched, saturated or unsaturated alkyl radical having 7 to 11 carbon atoms and $Z_n$ represents a polyglycosyl radical having an average value of from 1 to 3 hexose or pentose units or mixtures thereof, and
(ii) from 3 to 20% by weight of a mixture of longer-chain alkyl polyglycosides of the formula (II)

$$R'—O—Z'_m \quad (II)$$

in which R' is a linear or branched, saturated or unsaturated alkyl radical having 12 to 18 carbon atoms or mixtures thereof and $Z'_m$ represents a polyglycosyl radical having an average value of from 1.1 to 2 hexose or pentose units or mixtures thereof, with
(B) 3 to 30% of a fatty alcohol ethoxylate,
(C) 5 to 30% of a soap, and
(D) 0 to 5% of other surfactants.

16. The low-foaming detergent composition of claim 7, wherein said composition is liquid.

17. The low-foaming detergent composition of claim 7, wherein said composition is pulverulent.

* * * * *